US008047151B2

(12) United States Patent
Foo et al.

(10) Patent No.: US 8,047,151 B2
(45) Date of Patent: Nov. 1, 2011

(54) SYSTEM AND METHOD FOR MOORING OF OFFSHORE STRUCTURES

(75) Inventors: Kok Seng Foo, Singapore (SG); Asbjorn Mortensen, Heritage View (SG); Rune Henriksen, Dover Parkview (SG); Chai Wah Koh, Singapore (SG); Toh Tung Wong, Singapore (SG)

(73) Assignees: Keppel Offshore & Marine Technology Centre Pte Ltd, Singapore (SG); Offshore Technology Development Pte Ltd, Singapore (SG)

( * ) Notice: Subject to any disclaimer, the term of this patent is extended or adjusted under 35 U.S.C. 154(b) by 259 days.

(21) Appl. No.: 12/511,588

(22) Filed: Jul. 29, 2009

(65) Prior Publication Data

US 2010/0024706 A1 Feb. 4, 2010

Related U.S. Application Data

(60) Provisional application No. 61/085,557, filed on Aug. 1, 2008.

(51) Int. Cl.
*B63B 21/00* (2006.01)

(52) U.S. Cl. ..... 114/230.2

(58) Field of Classification Search ..... 114/230.2, 114/230.22, 230.23, 230.24, 230.25, 230.26, 114/230.27, 230.28, 230.29, 199, 200, 293, 114/294; 254/389

See application file for complete search history.

(56) References Cited

U.S. PATENT DOCUMENTS

| | | | | |
|---|---|---|---|---|
| 3,842,776 | A * | 10/1974 | Wudtke | 114/294 |
| 3,905,190 | A | 9/1975 | Pearlman | |
| 4,958,805 | A | 9/1990 | Willamsson | |
| 5,845,893 | A * | 12/1998 | Groves | 254/389 |
| 6,651,580 | B2 * | 11/2003 | Lay et al. | 114/293 |
| 6,817,595 | B1 * | 11/2004 | Jenkins et al. | 254/389 |
| 7,104,214 | B2 * | 9/2006 | Niebur | 114/230.2 |

(Continued)

FOREIGN PATENT DOCUMENTS

WO 2008067406 A2 6/2008

OTHER PUBLICATIONS

International Property of Singapore; International Search and Examination Report; Singapore Application No. SG 200905095-6; Jul. 1, 2010; 9 pgs.

*Primary Examiner* — Daniel Venne

(74) *Attorney, Agent, or Firm* — Conley Rose, P.C.; J. Robert Brown, Jr.

(57) ABSTRACT

A system and method for configuring and supporting mooring lines deployed on offshore structures, e.g. Spar-type platform, are provided with recessed portions that are located around the splash/ice zones for "cutting" through waves. An offshore structure may be provided with a chain tensioning mechanism that applies a desired tension to a hull chain and mooring line during mooring. Upon mooring the offshore structure, a chain lock mechanism maintains the tension in the hull chain and mooring line, while the chain tensioning mechanism releases a portion of the hull chain which is to be stored in a chain housing which is fully submerged underwater. This way, the recessed portions of the offshore structure around the splash/ice zones would be substantially free of the hull chains. Additionally, a disconnect mechanism may be provided to allow quick and safe disconnection of the offshore structure from the mooring position.

21 Claims, 10 Drawing Sheets

U.S. PATENT DOCUMENTS

| | | | | |
|---|---|---|---|---|
| 7,197,999 | B2 | 4/2007 | Murray | |
| 7,377,225 | B2 | 5/2008 | Finn et al. | |
| 7,392,757 | B2 * | 7/2008 | Niebur | 114/200 |
| 7,510,452 | B2 | 3/2009 | Van Tol et al. | |
| 2001/0029878 | A1 | 10/2001 | Seaman et al. | |
| 2005/0072347 | A1 | 4/2005 | Niebur | |
| 2008/0311804 | A1 | 12/2008 | Bauduin et al. | |

* cited by examiner

SYSTEM AND METHOD FOR MOORING OF OFFSHORE STRUCTURES

CROSS-REFERENCE TO RELATED APPLICATIONS

The present application claims priority to U.S. Provisional Patent Application No. 61/085,557, filed Aug. 1, 2008, by Kok Seng Foo, et al., entitled "System and Method for Mooring of Offshore Structures," which is incorporated by reference herein as if reproduced in its entirety.

BACKGROUND

Offshore structures (e.g. floating production and drilling platforms, SPAR platforms, floating storage and offloading vessels) are typically held in place in the ocean through use of anchoring or mooring lines. One end of the lines is attached to chain stoppers typically mounted on the offshore structures while the other end of the lines is attached to anchors or anchoring piles that are embedded into the seabed. Such an anchoring configuration allows the offshore structures to stabilize and secure themselves in an operating location amid the harsh, unpredictable weather and environmental conditions generally experienced in the ocean.

In some offshore structures (e.g. SPAR platforms that may operate in Arctic conditions), supporting columns of the offshore structures are designed with circumferential recesses at sections that are approximately located at or near to the sea level. The reduced cross-sectional area of the supporting columns at those sections assists the offshore structures in "cutting" through oncoming waves or ice chunks, thereby mitigating the effects of any undesirable loading forces that might otherwise be transmitted therefrom to the offshore structures. However, the circumferential recesses also expose the chains of the mooring lines (refer to FIG. 1) which are typically guided down along the supporting columns to chain fairleads attached thereto at or below the sea level.

Consequently, the exposure of the chains poses several problems. Firstly, the exposed chains might result in accumulation or encourage formation of unwanted articles such as ice chunks around the recessed sections, thereby inadvertently increasing the cross-sectional area of the recessed sections. In addition, there is also a greater chance and risk of severing the chains should a boat accidentally steer into the supporting columns which might then endanger the lives of the crew on the offshore structure.

U.S. Pat. No. 7,377,225 B2 discloses a spar-type platform which includes a hull defining a centerwell extending downward to a keel. The hull includes a reduced diameter neck portion for diverting ice flow. Adjustable ballast tanks allow the hull to be moved between a ballasted down position defining an upper water line, and a ballasted up position defined by a lower water line. A riser a support buoy is disposed in the keel. Risers extend through the centerwell, each having an upper portion extending upward from the support buoy and a lower portion supported in the support buoy. A disconnect system detachably connects the support buoy to the hull and the upper portion of each riser to the lower portion thereof, whereby the hull and the upper portion of each riser are selectively detachable from the buoy and the lower portion of each riser for movement to avoid a collision with a floating object. The disconnect system comprises a remotely operable riser coupler that releasably couples the upper portion of each riser to the lower portion thereof, a latch mechanism that is remotely-operable to releasably secure the buoy to the keel of the hull.

U.S. Pat. No. 7,197,999 B2 discloses a spar-type offshore platform which includes a buoyant upper hull structure supporting a deck and having lower end in which is received a buoyant lower mooring module. The upper hull structure is connected to the mooring module by connection lines. The upper hull structure is removed from the mooring module by disconnecting the connection lines from the upper hull structure while leaving the connection lines attached to the mooring module and while the mooring module remains moored to the seabed.

U.S. Publication No. 2008/0311804 A1 illustrates a system, for use at offshore locations of large depth, for mooring a production vessel or floating unit at a location over a hydrocarbon reservoir and for connecting risers that can be carrying hydrocarbons up from the sea floor to a production vessel that stores the hydrocarbons, flowlines for water injection, gas lift, gas export, umbilicals and mooring lines that moor the vessel. Both the mooring lines and the risers are disconnectably connected to the vessel through a connection buoy, or connector.

U.S. Pat. No. 7,510,452 B2 illustrates a disconnectable mooring system for a vessel comprises a mooring buoy member and a turret structure mounted in a moonpool of the vessel. The mooring buoy member is anchored to the seabed and has a plurality of passages each adapted to receive a riser. The turret structure has a receptacle for receiving the buoy member and a locking device for locking the buoy member in the receptacle.

SUMMARY

Embodiments of the invention provide a system and method for installing or mooring an offshore structure where a portion of a hull chain, which may otherwise be exposed to water in the "splash/ice zones" around the seawater level, may be stored fully submerged underwater after the offshore structure is moored into a desired position. Embodiments of the invention also provide a system and method for quick and safe disconnection of the offshore structure from a mooing line as and when required, especially when an object, e.g. boat or ice berg, is fast approaching which may damage the offshore structure.

According to one embodiment of the invention, a system for offshore installation may comprise an offshore structure body having an upper portion, a lower portion and a recessed portion interposed therein, a chain lock mechanism mounted to the body, a chain tensioning mechanism movably mounted on a deck of the body, and a chain housing. The hull chain may connect the chain tensioning mechanism to a mooring line via the chain lock mechanism. In a first mode of operation, the chain tensioning mechanism may be operable to apply a tension to a hull chain and a mooring line to secure the offshore structure in place. In a second mode of operation, the chain lock mechanism may be operable to maintain the tension in the hull chain and the mooring line while the chain tensioning mechanism may be operable to release a first portion of the hull chain. The released first portion of the hull chain may be guided into the chain housing to be stored fully submerged underwater, thus rendering the recessed portion of the offshore structure body substantially free of the hull chain. The unreleased second portion of the hull chain would remain connected to the mooring line at the desired tension. The recessed portion of the offshore structure body may coincide with the splash/ice zones located approximately around the water surface level. Accordingly, the released first portion of the hull chain, which is now stored in the chain housing, would not be caught within the ice sheets formed in the splash/ice zones.

According to one embodiment of the invention, a method may comprise providing an offshore structure which comprises a body having a recessed portion interposed therebetween, a chain lock mechanism and a chain housing mounted to the lower portion of the body, a chain tensioning mechanism movably mounted on a deck of the upper portion of the body. The method may further comprise applying a tension to a hull chain using the chain tensioning mechanism, where the hull chain connects the chain tensioning mechanism to a mooring line via the chain lock mechanism. While maintaining the tension in the hull chain using the chain lock mechanism, the method further comprises releasing a first portion of the hull chain engaged by the chain tensioning mechanism and guiding the released first portion of the hull chain into the chain housing for rendering the recessed portion of the offshore structure substantially free of the hull chain. The method may further comprise maintaining the released first portion of the hull chain fully submerged underwater.

In certain embodiments, a disconnect mechanism may be provided between the hull chain and mooring line. The disconnect mechanism may allow quick and safe detachment of the offshore structure from the mooring line as and when required.

The above and other features of the embodiments of the invention will be described in greater details in the following paragraphs.

BRIEF DESCRIPTION OF THE DRAWINGS

Embodiments of the invention are disclosed hereinafter with reference to the drawings, in which.

DETAILED DESCRIPTION

Figure 1:
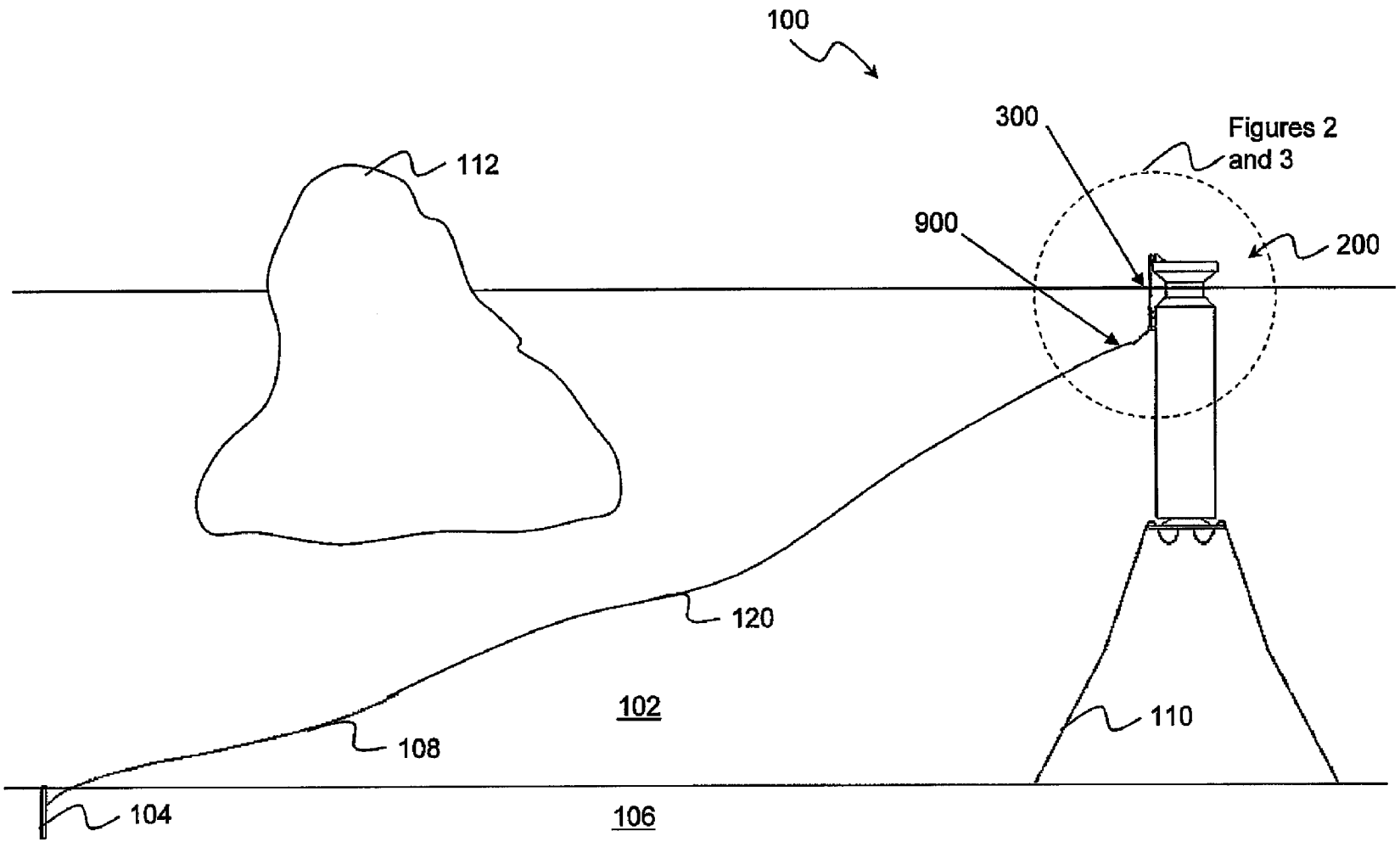
FIG. 1 illustrates a mooring configuration in accordance with one embodiment of the invention.

In the following description, numerous specific details are set forth in order to provide a thorough understanding of various illustrative embodiments of the invention. It will be understood, however, to one skilled in the art, that embodiments of the invention may be practiced without some or all of these specific details. In other instances, well known process operations have not been described in detail in order not to unnecessarily obscure pertinent aspects of embodiments being described. In the drawings, like reference numerals refer to same or similar functionalities or features throughout the several views.

Embodiments of the invention relate generally to anchoring and mooring systems for offshore structures. Particularly, but not exclusively, embodiments of the invention pertain to a system for configuring and supporting mooring lines used in such structures, and to a disconnect mechanism that allows safe and quick disconnection of the offshore structures from the mooring lines.

Embodiments of the invention provide a system and method for configuring and supporting mooring chains deployed on offshore supporting structures and to a disconnect mechanism that allows safe and quick detachment of the offshore structures from the mooring lines.

FIG. 1 shows a mooring configuration 100 in which an offshore structure 200, e.g. a Spar-type platform, is deployed in deep waters 102 and moored to an anchor pile 104 (or suction anchor) secured to an underwater floor 106 or structure. It is to be appreciated that embodiments of the invention may be applicable to other types of offshore structures with suitable modifications. In a moored position, the offshore structure 200 may be secured to the anchor pile 104 via an anchor chain 108, a mooring line 120, a mooring disconnect mechanism 900, a hull chain 300, or a combination thereof. Production risers 110 may connect the offshore structure 200 to an underwater source to transmit oil, gas or other natural resources to the offshore structure. A disconnect mechanism 900 may be interposed between a hull chain 300 and a mooring line 120 to provide quick and safe detachment of the offshore structure 200 from the mooring line 120 or moored position. This may be required in situations where an object, e.g. iceberg 112, is fast approaching which may cause damage to the offshore structure 200 and possibly oil and gas leakages to the environment. As and when required, the production risers 110 may also be disconnected to detach the offshore structure 200 from the underwater source.

Figure 3:
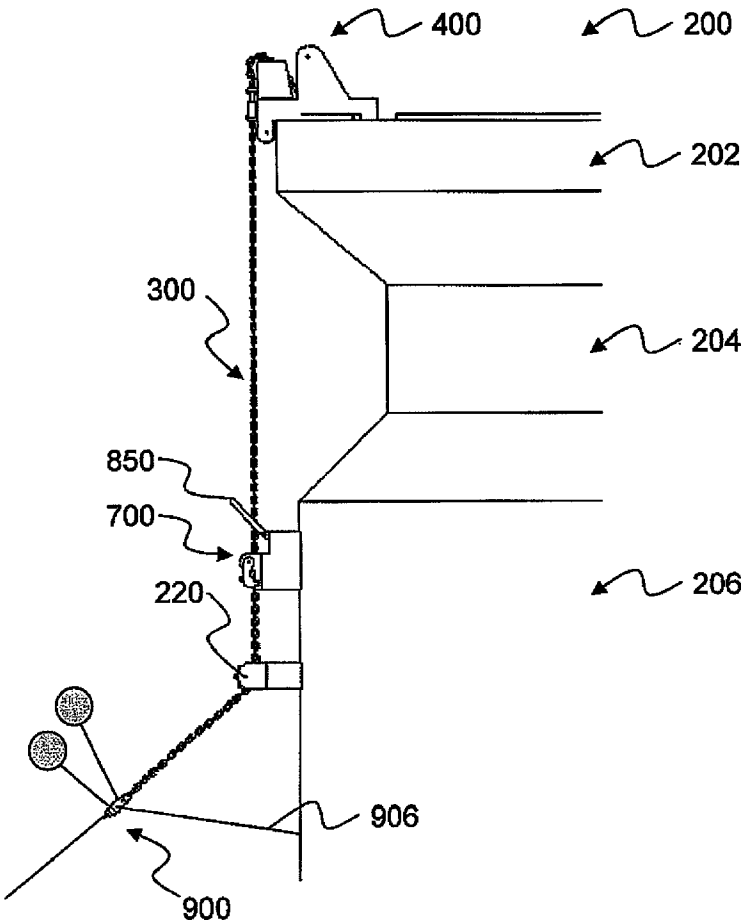
FIG. 3 is a side view of the system of FIG. 2.
Figure 2:
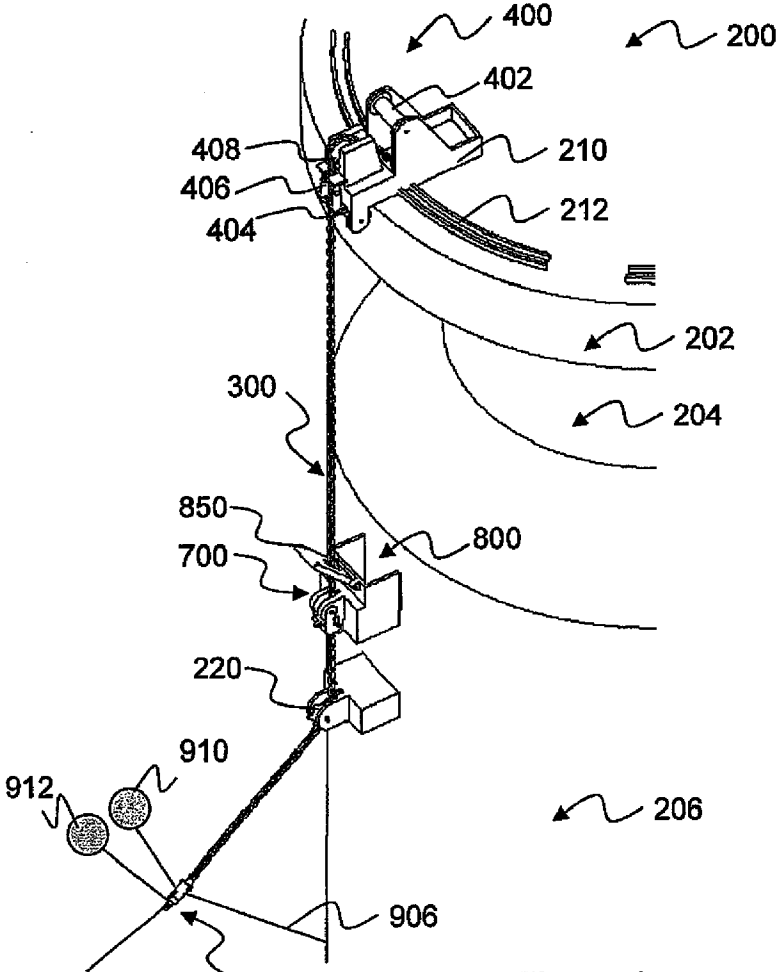
FIG. 2 is a perspective view of a system for configuring and supporting mooring lines deployed on offshore structures in accordance with one embodiment of the invention.
Figure 4B:
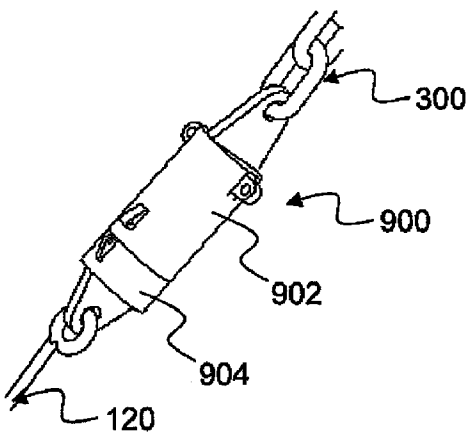
FIGS. 4A and 4B show partial magnified perspective views of the components in the system of FIG. 2.
Figure 4A:
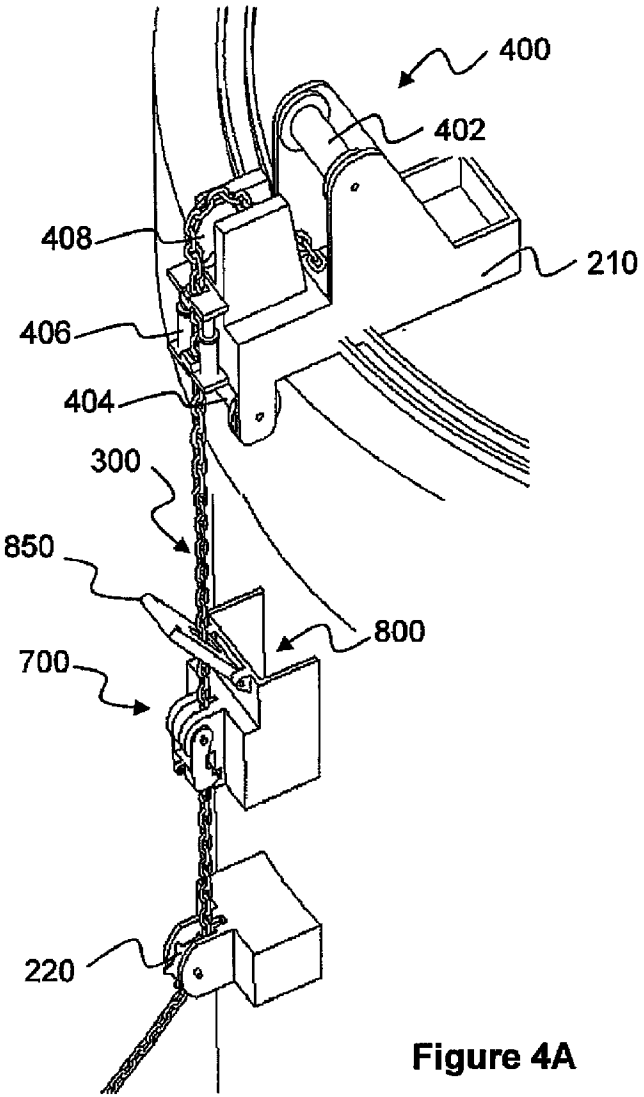

FIG. 2 shows a perspective view of a system for configuring and supporting mooring lines 120 deployed on offshore supporting structures in accordance with one embodiment of the invention. FIG. 3 is a side view of the system of FIG. 2. FIGS. 4A and 4B show partial magnified perspective views of the components in the system of FIG. 2. As illustrated, an offshore structure 200 may comprise a body, e.g. Spar body, having an upper portion 202, a lower portion 206 and a recessed portion 204 (or reduced diameter neck portion) interposed therebetween. The recessed portion 204 would normally coincide with the splash/ice zone located approximately around the level when the offshore structure 200 is in a moored position. Tapers may be interposed between the upper portion 202 and recessed portion 204 for deflecting an approaching ice sheet.

A chain tensioning mechanism 400 (or chain tensioner skid) may be movably mounted on a deck of the upper portion 202 of the body. For this purpose, a trolley 210 or a skidding or movable platform, and rail guides 212 may be provided on the deck to facilitate movement of the chain tensioning mechanism 400 between various working positions on the deck. It is to be appreciated that other arrangements may be envisaged to allow movement of the trolley 210 on the deck. The chain tensioning mechanism 400 may comprise a chain utility winch 402, a diverter/lock utility winch 404, a chain jack 406 and a fairlead 408, the functions and operation of which will be described in the later paragraphs. The chain utility winch 402 and the diverter/lock utility winch 404 may be operated by electric power or hydraulic power.

A chain lock mechanism 700 and another fairlead 220 may be mounted to the lower portion 206 of the body of the offshore structure 200, and located such that both the chain lock mechanism 700 and fairlead 220 may be fully submerged underwater when the offshore structure 200 is in a moored position.

Figure 8:
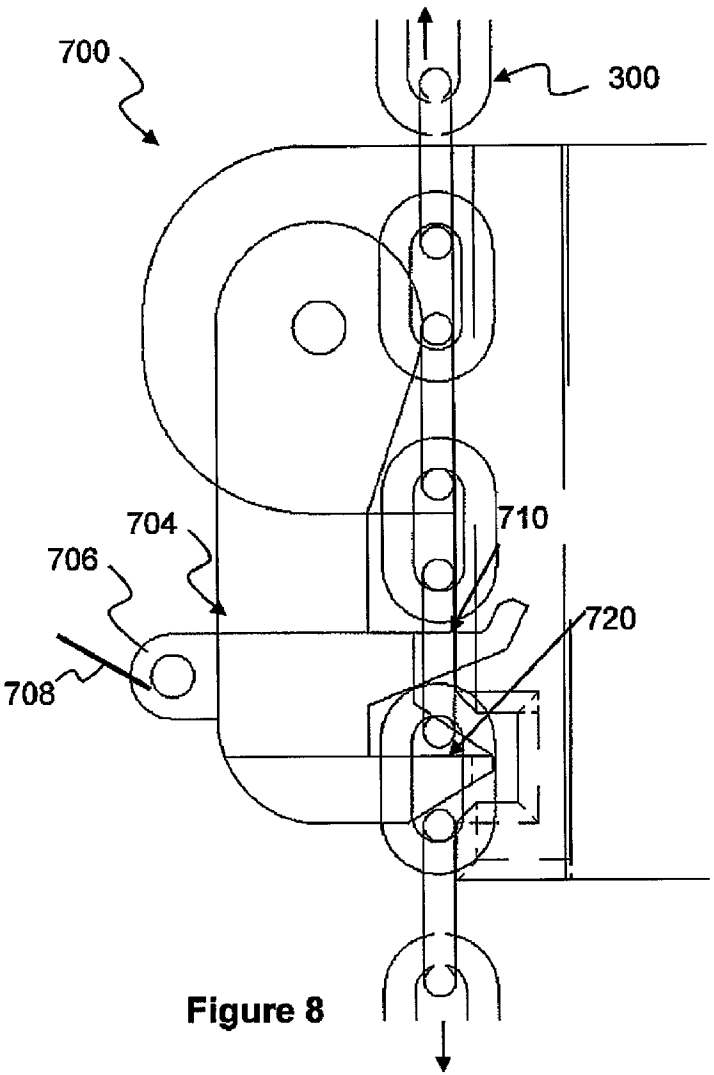
FIG. 8 is a cross-sectional view of the chain lock mechanism of FIG. 7.
Figure 7:
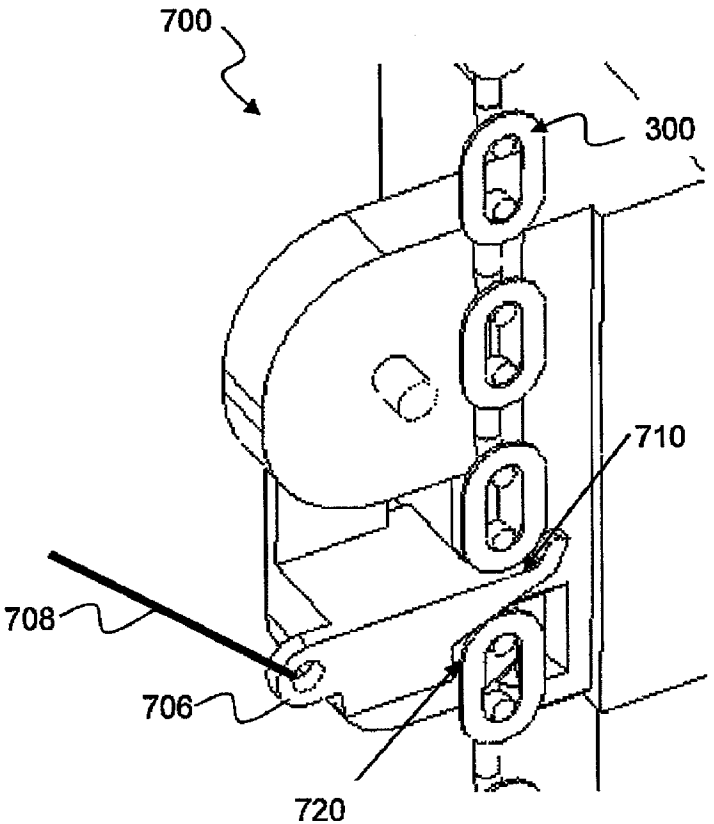
FIG. 7 is a partial perspective view of a chain lock mechanism.

FIGS. 7 and 8 show a chain lock mechanism 700 in an engaged or locked position. The chain lock mechanism 700 may comprise a first self-locking chain lock 710 which may be operable to maintain a desired tension in the hull chain 300. The chain lock mechanism 700 may further comprise a second self-locking chain lock 720 which may be operable to cooperate with the first self-locking chain lock 710 to maintain tension in the hull chain 300, or which may function as a safety (redundant) lock to maintain the tension in the hull chain 300 should the first self-locking chain 710 fail. In one embodiment, the self-locking chain locks 710, 720 may be operated in a single direction (i.e. a reverse application of force on the chain locks self-tightens the chain lock and increases the tension therein). The chain lock mechanism 700 may further comprise a swing arm 704 and, a docking mechanism 706 for enabling a remotely-operated vehicle (ROV) to attach a wire 708 thereto. The chain lock mechanism 700 may allow tightening or an increase in the tension of the hull chain 300. The chain lock mechanism may not allow releasing or a decrease in the tension of the hull chain 300 unless a wire 708 is attached to the docking mechanism 706 to pull the first self-locking chain lock 710 for releasing tension in the hull chain 300.

A hull chain 300 may connect the chain tensioning mechanism 400 to a mooring line 120 via the chain lock mechanism 700 and fairlead 220. The fairlead 220 (which may be known as swivel fairlead or bending shoe) may guide or divert a portion of a hull chain 300 away from the offshore structure 200 (i.e. offsetting a portion of the hull chain 300 at an angle with respect to a longitudinal axis of the body of the offshore structure) to prevent lateral movement of the hull chain 300 and thereby securing of the hull chain 300 to a mooring line 120.

A chain housing 800 may be mounted to the lower portion 206 of the body of the offshore structure 200 and arranged to receive a portion of a hull chain 300 for storage. The chain housing 800 is appropriately positioned such that it would be fully submerged underwater when the offshore structure 200 is in a moored position. Accordingly, a portion of the hull chain 300 which is stored in the chain housing 800 would also be fully submerged underwater. By storing a portion of the hull chain 300 underwater and rendering the recessed portion 204 of the body of the offshore structure 200 substantially free of the hull chain 300, undesired accumulations and formation of ice particles that would have occurred to an exposed hull chain can be prevented. While the Figures illustrate the chain housing 800 being disposed in juxtaposition with the chain lock mechanism 700 being mounted to the chain housing 750, other arrangements of the chain housing 800 and chain lock mechanism 700 may be envisaged.

A movable lid 850 (or diverter lid) may be provided to secure a released portion of the hull chain 300 while a free end of the released portion of the hull chain 300 is being lowered into the chain housing 800 for storage. The movable lid 850 may be manipulated by attaching a wire 230*b* between the movable lid 850 to the diverter/lock utility winch 404 of the chain tensioning mechanism 400 (see FIG. 5), and adjusting (lifting or lowering) the wire 230*b* to operate the movable lid 850. By adjusting the movable lid 850, the released portion of the hull chain 300 may be secured and prevented from slipping through the movable lid 850 or slipping away, and thereby guiding the released portion of the hull chain 300 towards the chain housing 800. While the Figures show the movable lid 850 being pivotally-mounted to the chain housing 800, it is to be appreciated that the movable lid 850 may be mounted to other parts of the offshore structure 200 as appropriate.

Figure 5:
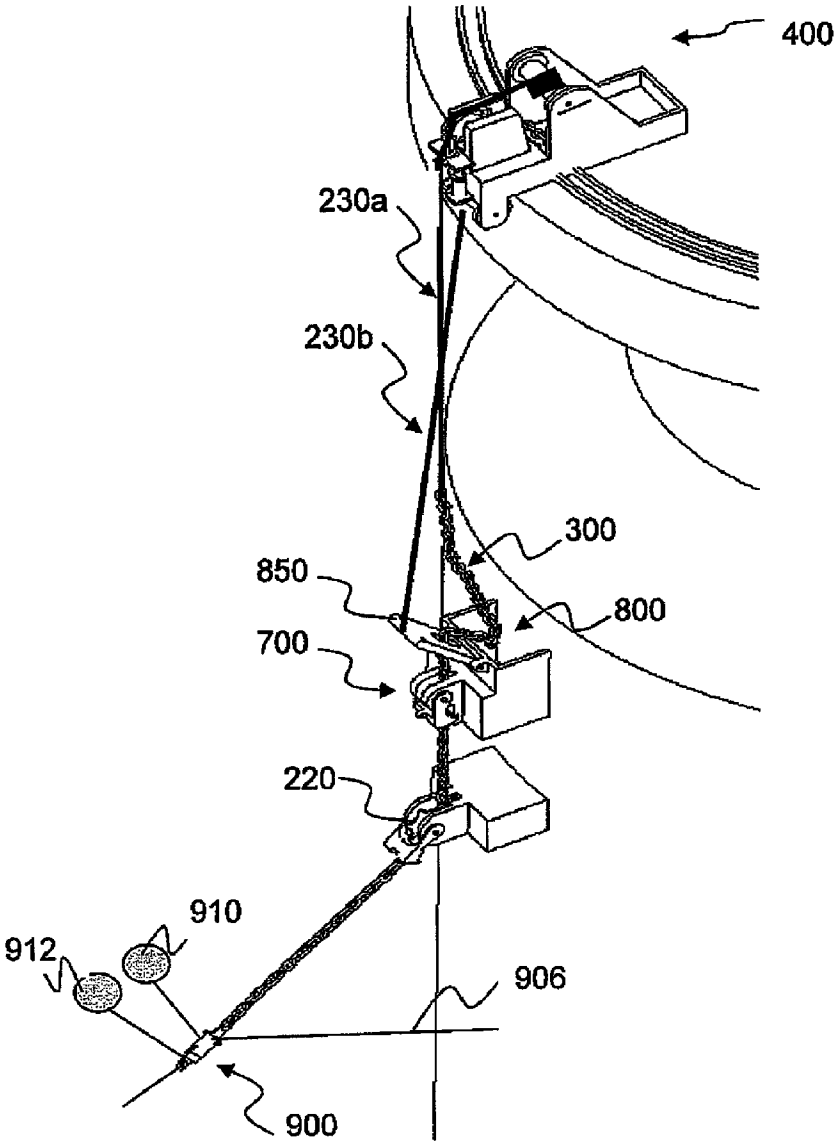
FIGS. 5 and 6 show the system of FIG. 2 in different stages of operation.
Figure 6:
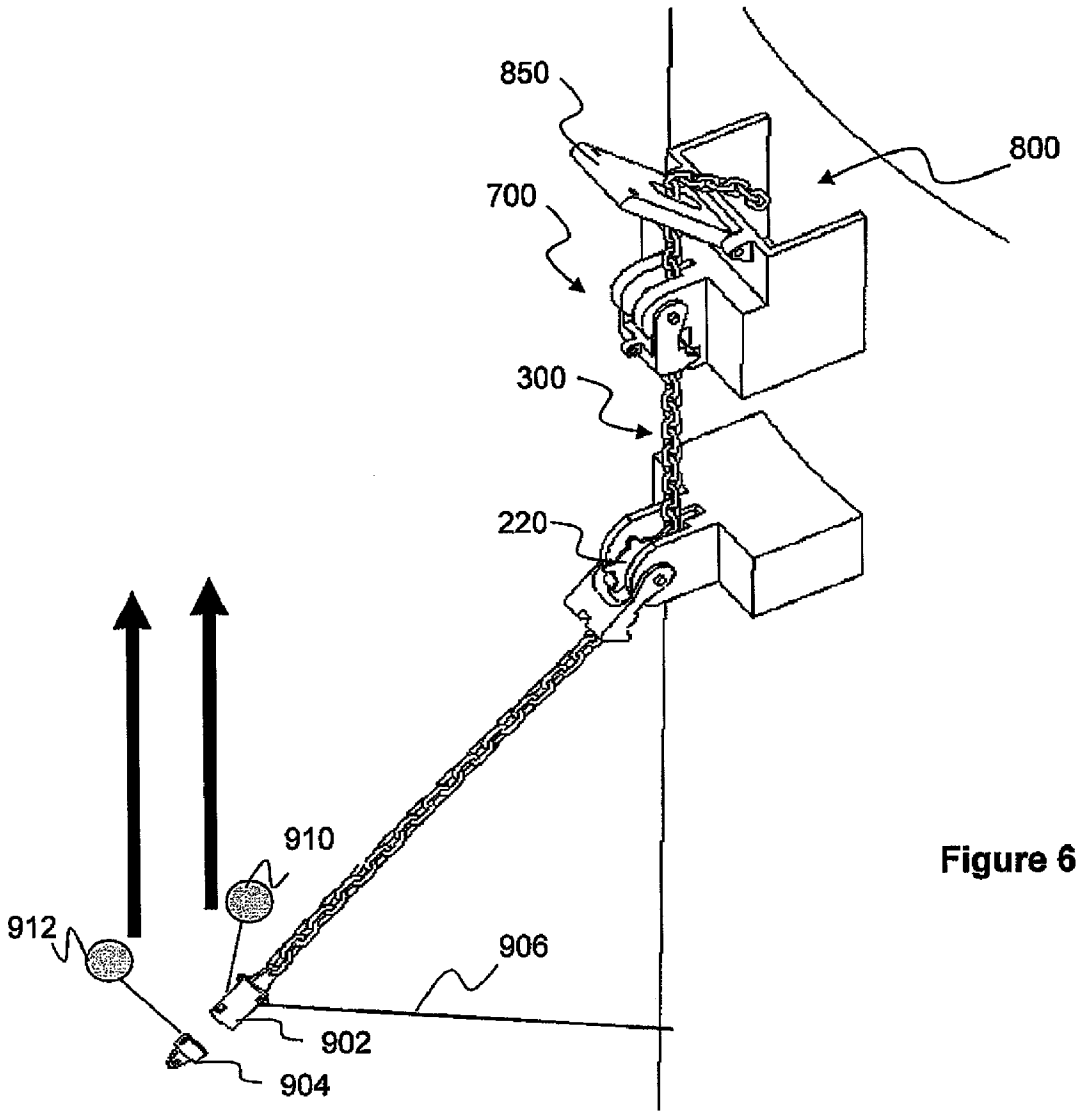

In a moored position, the hull chain 300 connects the offshore structure 200 to a mooring line 120 at a desired tension maintained by the chain lock mechanism 700. A disconnect mechanism 900 may be interposed between the hull chain 300 and a mooring line 120 to allow quick detachment of the hull chain 300 from the mooring line 120 as and when required. FIG. 5 shows an offshore structure 200 in a moored position with the disconnect mechanism 900 in an engaged position. FIG. 6 shows the offshore structure 200 detached from the mooring line 120 with the disconnect mechanism 900 in a disengaged position. In emergency situations, e.g. due to possible impact of an iceberg, the disconnect mechanism 900 may be activated to disconnect or detach the hull chain 300 from the mooring line 120 so that the offshore structure 200 may be moved away to safety. The disconnect mechanism 900 may be operable to automatically detach in other situations, e.g. when a tension in the hull chain reaches a predetermined limit. Upon detachment, buoys 910, 912 attached to parts of the disconnect mechanism 900 may ascend towards the water surface level, instead of descending towards the underwater floor, so that parts of the disconnect mechanism may be easily retrieved and subsequently reconnected or coupled as and when required. Depending on the length of the hull chain 300, the buoys 910, 912 may eventually float at the water surface level, or maintained buoyant underwater. In certain embodiments where an offshore structure 200 is moored using multiple mooring lines 120, detachment of the disconnect mechanisms at the various mooring lines may take place in phases to maintain balance of the offshore structure 200.

Figure 9A:
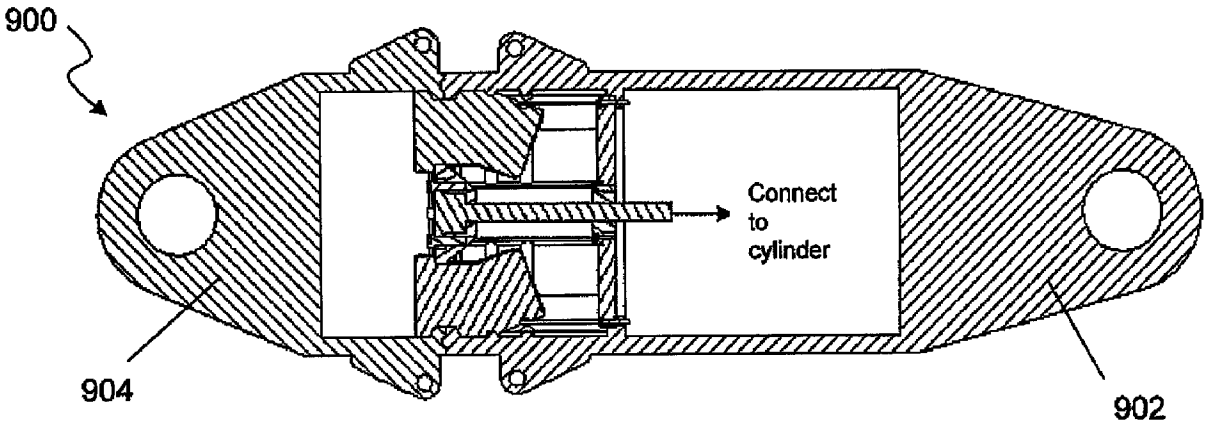
FIG. 9A is a cross-sectional view of a disconnect mechanism in an engaged mode.
Figure 9B:
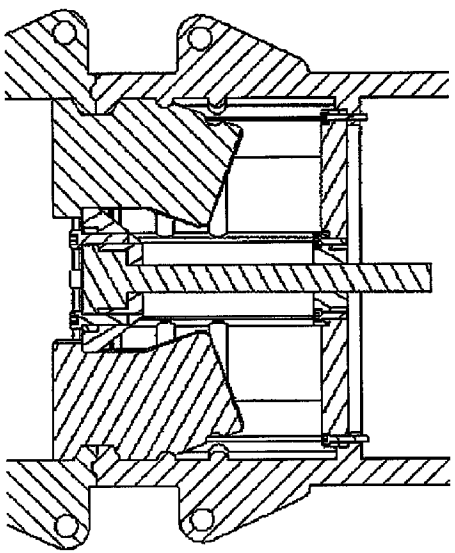
FIG. 9B shows a partial magnified view of the engaged internal interlocking mechanism of the disconnect mechanism of FIG. 9A.

FIG. 9A illustrates a disconnect mechanism 900 which comprises a first (or male or active) component 902 and a second compatible (or female or passive) component 904 in an engaged position. FIG. 9B is a cross-sectional view of the internal interlocking mechanisms of FIG. 9A. The disconnect mechanism 900 may be activated, such as by electrical or ultrasonic signals or both (for redundancy purpose), to detach the first component 902 from the second component 904. For this purpose, separate electric cables 906 may be provided connecting the first 902 and/or the second component 904 to the offshore structure 200; electronic and hydraulic circuits may also be provided. The disconnect mechanism 900 may be electrically charged and self-tested for system integrity, without actual detachment, at predetermined time intervals or continuously to ensure that the disconnect mechanism 900 is fully operational. Hydraulic energy may be stored in accumulators in the first (or male) component 902 and over time a hydraulic pump may replenish any loss in pressure. The hydraulic energy may be utilised in detaching the first 902 and second 904 components. In one embodiment, a first (or male) component 902 may be attached to the hull chain 300 while a second (or female) component 904 may be attached to the mooring line 120. The mooring line 120 may be connected to an anchor pile 104 embedded in the underwater floor 106.

Figure 10A:
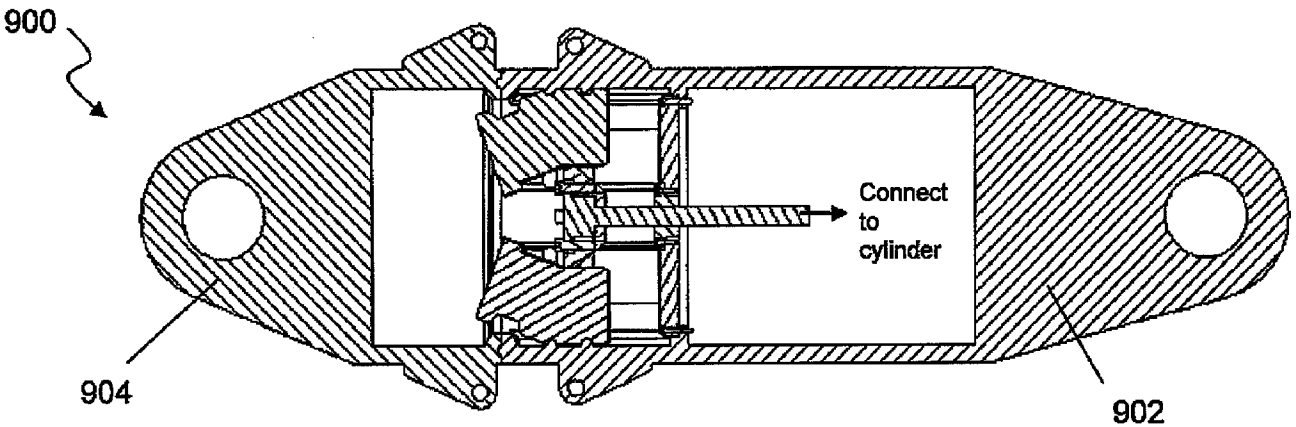
FIG. 10A is a cross-sectional view of a disconnect mechanism in a disengaged mode.
Figure 10B:
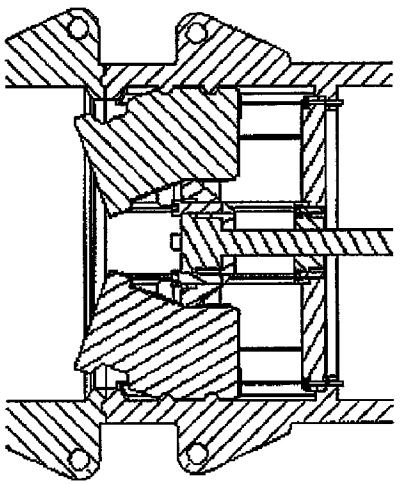
FIG. 10B shows a partial magnified view of the disengaged internal interlocking mechanism of the disconnect mechanism of FIG. 10A.

FIG. 10A illustrates the disconnect mechanism 900 of FIG. 9A in a disengaged position. FIG. 10B is a cross-sectional view of the internal interlocking mechanisms of FIG. 10A.

Figure 11B:
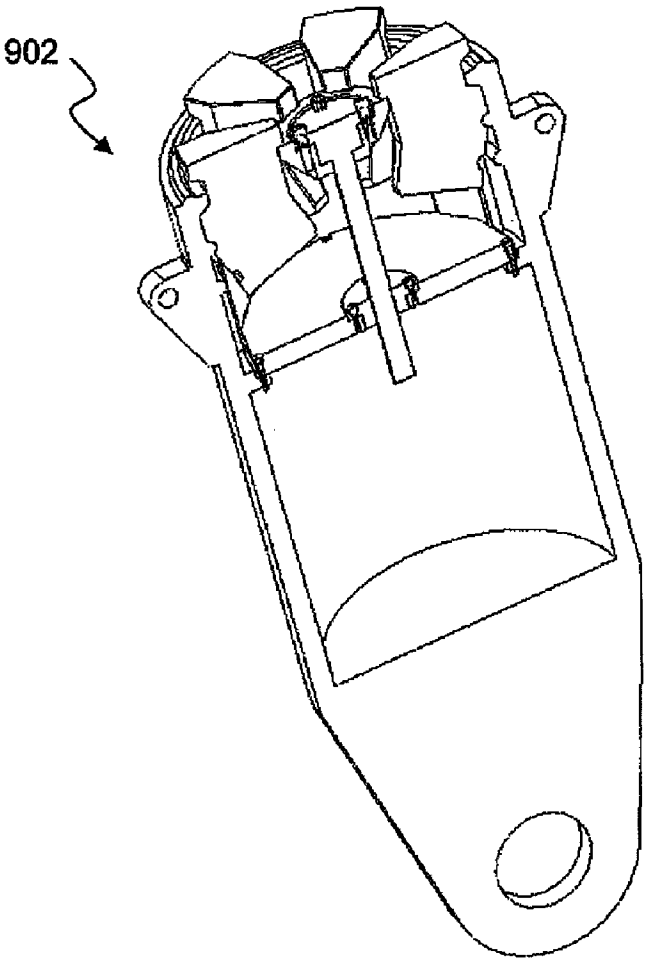
FIG. 11B is a three-dimensional cross-sectional view of the male component of FIG. 11A.
Figure 11A:
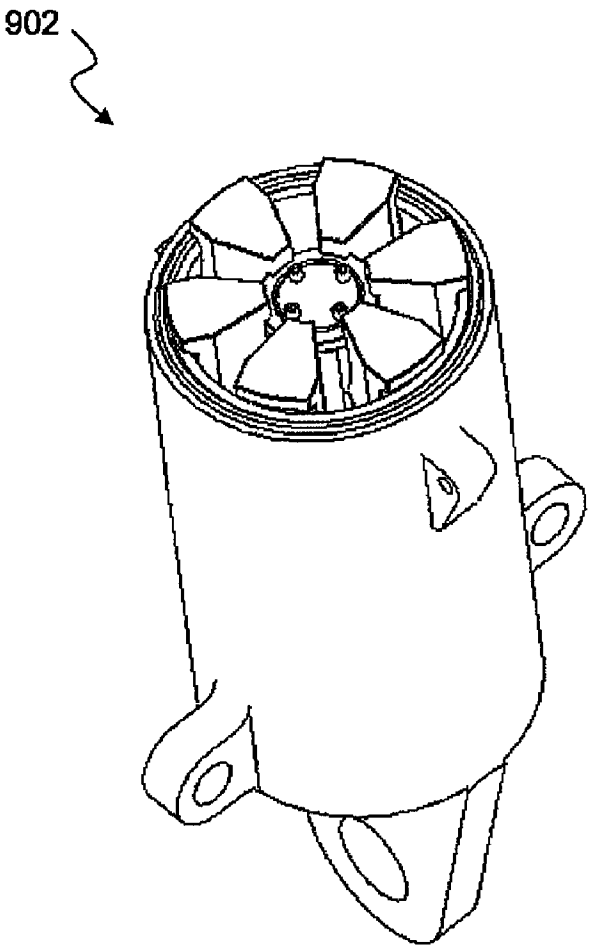
FIG. 11A shows a male component of the disconnect mechanism.
Figure 12B:
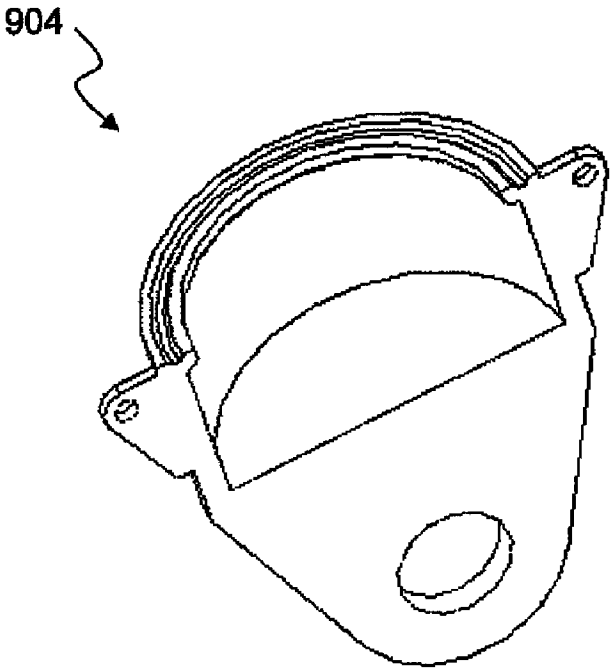
FIG. 12B is a three-dimensional cross-sectional view of the female component of FIG. 12A.
Figure 12A:
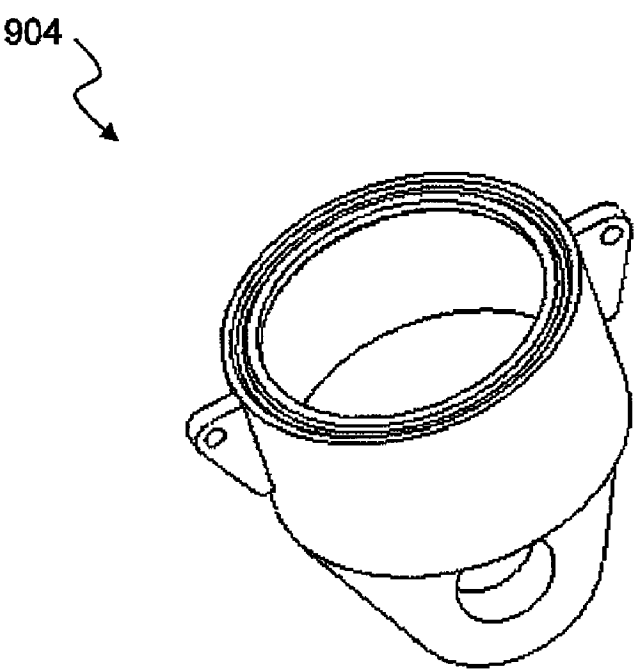
FIG. 12A shows a female component of the disconnect mechanism.

FIG. 11A shows a male component of the disconnect mechanism 900 while FIG. 11B is a three-dimensional cross-sectional view of the male component of FIG. 11A. FIG. 12A shows a female component of the disconnect mechanism 900 while FIG. 12B is a three-dimensional cross-sectional view of the female component of FIG. 12A. It is to be appreciated that the illustrations of the disconnect mechanism 900 and its internal mechanisms are exemplary only and may be suitably modified by persons skilled in the art.

An exemplary method or sequence of mooring an offshore structure 200, according to one embodiment of the invention, is described as follows. It is to be appreciated that some of the described sequences and steps may be modified, interchanged or omitted as and when required.

The method may include providing an offshore structure 200 which comprises a body having an upper portion 202, a lower portion 206 and a recessed portion 204 interposed therebetween, a chain lock mechanism 700 mounted to the lower portion 206 of the body, a chain tensioning mechanism 400 movably mounted on a deck of the upper portion 202 of the body, a chain housing 800 mounted to the lower portion 204 of the body for storing a portion of the hull chain 300, and a fairlead 220. It is to be appreciated that the aforesaid components may be pre-assembled before being delivered to an offshore site.

The method may further include providing one or more hull chains 300. The hull chain 300 may be connected to an appropriate part (e.g. a first component 902) of the disconnect mechanism 900 on a work boat or water traveling vessel, or onshore before being delivered to an offshore site. A buoy 910 may be attached to the male component 902 to allow the male component 902 ascend towards the water surface level for easy retrieval. At the offshore structure 200, a pilot wire may first be provided through utility winches 402 of the chain tensioning mechanism 400, movable lid 850, chain lock mechanism 700 and fairleads 220 with the guidance of a remotely-operated vehicle. The pilot wire may be brought onboard a work boat to be attached to the hull chain 300. Using the attached pilot wire, the hull chain 300 may be pulled back to the chain jack 406 via a fairlead 408 of the chain tensioning mechanism 400 which prevents lateral movement of the hull chain 300.

At an appropriate location proximate to the offshore site, an anchor pile 104 may be installed or pre-installed at an underwater floor 106. An anchor chain 108 and/or a mooring line 120 may be attached to the anchor pile 104. At one free end of the mooring line 120 which is to be connected to the offshore structure 200, an appropriate part (e.g. a second or female component 904) of a disconnect mechanism 900 may be attached thereto. Another buoy 912 may be attached to the female component 904 to allow the female component 904 ascend towards the water surface level for easy retrieval when required. The female component 904 may be brought onto the offshore structure 200, such as in a separate work boat, to be connected or coupled to the male component 902 while the hull chain 300 may remain onboard the first work boat. This way, the disconnect mechanism 900 is disposed in an engaged position such that the hull chain 300 is connected to the mooring line 120 via the disconnect mechanism 900.

The method may then proceed to securing the hull chain 300, which connects between the chain tensioning mechanism 400 and a mooring line 120 via the chain lock mechanism 700 and fairlead 220, at a desired tension. The chain tensioning mechanism 400 applies a tension to the hull chain 300 using the chain jack 406. Upon achieving the desired tension and position in the hull chain 300, the chain lock mechanism 700 may self-lock to maintain the desired tension. The above-described process of securing the hull chain 300 between the chain tensioning mechanism 400 and the mooring line, and applying a desired tension to the hull chain may be referred to as a first mode of a mooring operation.

After the hull chain 300 is secured at the desired tension and position, the method may proceed to releasing a portion of the hull chain 300 and storing the released portion of the hull chain 300 in the chain housing 800. More particularly, the chain tensioning mechanism 400 may release a portion of the hull chain 300 which connects the chain tensioning mechanism 400 to the chain lock mechanism 700 (herein referred to as a first portion), while the chain lock mechanism 700 maintains the desired tension in a portion of the hull chain 300 which connects the chain lock mechanism 700 to the mooring line 120 (herein referred to as a second portion).

The released first portion of the hull chain 300 may be stored into the chain housing 800 for rendering the recessed portion 204 of the body of the offshore structure 200 substantially free of the hull chain 300. More particularly, a first wire 230*a* may be attached to a free end of the hull chain 300 and operable by the chain utility winch 402 to guide the released first portion of the hull chain 300 into the chain housing 800. A second wire 230*b* may connect the movable lid 850 to the diverter/lock utility winch 404 of the chain tensioning mechanism 400 using a remotely-operated vehicle. The second wire 230*b* may be operable by the diverter/lock utility winch 404 to manipulate the movable lid 850 which may be pivotally adjusted to secure the hull chain 300. This would prevent the released first portion of the hull chain 300 from slipping through the movable lid 850 or slipping away, and guide the first portion of the hull chain 300 towards the chain housing 800.

After the released first portion of the hull chain 300 is stored in the chain housing 800, the recessed portion 204 of the body of the offshore structure 200 is substantially free of the hull chain 300. Further, the released first portion of the hull chain 300 is stored in the chain housing 800 and is maintained fully submerged underwater. This way, undesired accumulations and formation of ice particles on the hull chain 300 can be prevented, especially in cold regions, e.g. Arctic regions, where the underwater temperature may be above zero degrees Celsius, which is not conducive to ice formation, while the temperature around the water surface level or in the air may be sub-zero which is conducive to ice formation. Also, the absence of an exposed hull chain in the splash/ice zones also reduces the dangers posed by approaching objects, e.g. ice bergs. Although the unreleased second portion of the hull chain 300 remains exposed to the seawater, this portion of the hull chain 300 is generally located in waters having a temperature above zero which is not conducive to ice formation and at an underwater level not generally threatened by icebergs. The above-described process of storing a portion of the hull chain 300 in the chain housing 800 may be referred to as a second mode of a mooring operation.

The method may further include electrically charging and self-testing the disconnect mechanism 900 for system integrity at predetermined time intervals or continuously. There would be no actual detachment during self-testing which is to ensure that the disconnect mechanism 900 is fully operational. As and when required to activate the disconnect mechanism 900, the method further includes remotely operating the disconnect mechanism by transmitting an appropriate signal to initiate detachment of the hull chain 300 from the mooring line 120. Examples of an appropriate signal include, but are not limited to, electrical and ultrasonic signals.

In certain embodiments, an offshore structure 200, e.g. a Spar platform, may be moored using multiple mooring lines 120. The mooring lines 120 may be equally or unequally distributed over a circumference of the body of the offshore structure. When tensioning of each mooring line 120 is completed and a released first portion of each hull chain 300 is stored in a chain housing 800, the chain tensioning mechanism 400 may be appropriately repositioned to work on tensioning successive mooring lines 120. The chain tensioning mechanism 400 may be movable between various positions using rail guides located on a deck of the offshore structure. After all the mooring lines 120 are tensioned and deployed, the chain tensioning mechanism 400 may be removed from the deck of the offshore platform or stored until it is subsequently required.

Embodiments of the invention achieve various advantages. There are no hull chains exposed to seawater at the recess portions of the offshore structure which coincide with the splash/ice zones, thereby eliminating unwanted accumulation of particles. Hence, there is no risk of exposed hull chains being severed as a result of boats accidentally steering into the offshore structure or encroaching ice bergs. Further, portions of hull chains of the mooring lines are safely stored in the chain housing which is fully submerged underwater, while the desired tension in the mooring line is maintained by the chain lock mechanism. This way, accumulation and formation of ice on the released portion of the hull chain can be prevented. Additionally, since the chain tensioning mechanism is only required in the initial stages of deploying the mooring lines and can be stored thereafter, equipment maintenance is therefore considerably easier. Also, since the chain tensioning mechanism may be movable between various positions for deploying multiple mooring lines, lesser equipment is required as compared to conventional systems. This results in substantial cost savings and weight reduction of the offshore structure. Further, the disconnect mechanism as described above allows quick and safe disconnection of the offshore structure from the mooring lines. This is useful in situations where an imminent danger threatens to damage the offshore structure. The disconnect mechanism also allows easy retrieval and connection (or reconnection) of the offshore structure to the mooring line.

Other embodiments will be apparent to those skilled in the art from consideration of the specification and practice of the invention. Furthermore, certain terminology has been used for the purposes of descriptive clarity, and not to limit the embodiments as disclosed. The embodiments and features described above should be considered exemplary, with the invention being defined by the appended claims.

What is claimed is:

1. A system for mooring an offshore structure comprising:

an offshore structure body having an upper portion, a lower portion and a recessed portion interposed therebetween;

a chain lock mechanism mounted to the lower portion of the offshore structure body;

a movable chain tensioning mechanism mounted on a deck of the upper portion of the body, the chain tensioning mechanism applying a tension to a hull chain, the hull chain connecting the chain tensioning mechanism to a mooring line by way of the chain lock mechanism; and a chain housing mounted to the lower portion of the body;

wherein the chain tensioning mechanism releases a first portion of the hull chain while the chain lock mechanism maintains the tension in a second portion of the hull chain, and wherein the chain housing receives the first portion of the hull chain to render the recessed portion substantially free of the hull chain.

2. The system of claim 1, wherein the chain lock mechanism comprises at least a first self-locking chain lock to maintain the tension in the hull chain.

3. The system of claim 1, further comprising a movable lid to guide the hull chain towards the chain housing.

4. The system of claim 1, further comprising a fairlead mounted to the lower portion of the body to receive the hull chain to guide the hull chain connecting the chain lock mechanism to the mooring line.

5. The system of claim 1, further comprising a disconnect mechanism to detachably couple the hull chain to the mooring line, the disconnect mechanism comprising a first component and a second compatible component for engaging thereto, wherein the first and the second components are detachable to release the hull chain from the mooring line by a remote command signal.

6. The system of claim 5, wherein the remote command signal is one of an electrical signal and an ultrasonic signal.

7. The system of claim 6, wherein the disconnect mechanism is electrically charged and self-tested for system integrity at a predetermined time interval.

8. The system of claim 5, further comprising a first buoy and a second buoy respectively coupled to the first and the second components, wherein the first and the second buoys guide the first and the second components towards a water surface level.

9. The system of claim 1, wherein the chain tensioning mechanism comprises a chain utility winch, a diverter utility winch and a chain jack, wherein the chain tensioning mechanism maintains the tension in the hull chain through the chain jack.

10. The system of claim 9, wherein the chain utility winch and the diverter utility winch are operable by one of electrical power and hydraulic power.

11. The system of claim 1, wherein the offshore structure body is a spar platform.

12. The system of claim 1, further comprising an anchor pile securing the mooring line to an underwater floor.

13. A method for mooring an offshore structure, the method comprising:

providing an offshore structure comprising a body having an upper portion, a lower portion and a recessed portion interposed therebetween, a chain lock mechanism and a chain housing mounted to the lower portion of the body, a movable chain tensioning mechanism mounted on a deck of the upper portion of the body;

applying a tension to a hull chain using the chain tensioning mechanism, the hull chain connecting the chain tensioning mechanism to a mooring line by way of the chain lock mechanism;

releasing a first portion of the hull chain which connects the chain tensioning mechanism to the chain lock mechanism while maintaining the tension in a second portion of the hull chain which connects the chain lock mechanism to the mooring line; and guiding the first portion of the hull chain into the chain housing to render the recessed portion substantially free of the hull chain.

14. The method of claim 13, further comprising:

before applying a tension to a hull chain, securing the hull chain to the mooring line by connecting a first component and a second compatible component of a disconnect mechanism which are respectively attached to the hull chain and the mooring line.

15. The method of claim 14, further comprising:

remotely operating the disconnect mechanism to detach the first component from the second component.

16. The method of claim 15, wherein remotely operating the disconnect mechanism further includes transmitting one of an electric signal and an ultrasonic signal to the disconnect mechanism.

17. The method of claim 16, further comprising:

electrically charging the disconnect mechanism and self-testing the disconnect mechanism for system integrity at a predetermined time interval.

18. The method of claim 14, further comprising: attaching a first buoy and a second buoy respectively to the first component and the second component of the disconnect mechanism.

19. The method of claim 13, further comprising: manipulating a movable lid for guiding the first portion of the hull chain towards the chain housing.

20. The method of claim 19, further comprising: attaching a wire between the movable lid and chain tensioning mechanism wherein the second wire is operable to manipulate the movable lid.

21. The method of claim 13, wherein guiding the first portion of the hull chain into the chain housing includes maintaining the first portion of the hull chain fully submerged underwater.

* * * * *